US008513599B2

(12) United States Patent
Franzen et al.

(10) Patent No.: US 8,513,599 B2
(45) Date of Patent: Aug. 20, 2013

(54) GUIDING SPRAY DROPLETS INTO AN INLET CAPILLARY OF A MASS SPECTROMETER

(75) Inventors: Jochen Franzen, Bremen (DE); Claus Köster, Lilienthal (DE)

(73) Assignee: Bruker Daltonik GmbH, Bremen (DE)

( * ) Notice: Subject to any disclaimer, the term of this patent is extended or adjusted under 35 U.S.C. 154(b) by 224 days.

(21) Appl. No.: 12/857,161

(22) Filed: Aug. 16, 2010

(65) Prior Publication Data

US 2011/0036974 A1 Feb. 17, 2011

(30) Foreign Application Priority Data

Aug. 17, 2009 (DE) ..... 10 2009 037 715

(51) Int. Cl.
*H01J 49/26* (2006.01)

(52) U.S. Cl.
USPC ..... 250/288; 250/281; 250/282; 250/283; 250/397; 250/396 R

(58) Field of Classification Search
USPC ..... 250/281, 282, 283, 288, 290, 291, 250/292, 293, 294, 295, 296, 297, 396 R, 250/397, 423 R
See application file for complete search history.

(56) References Cited

U.S. PATENT DOCUMENTS

| | | | | |
|---|---|---|---|---|
| 5,572,035 | A | 11/1996 | Franzen | |
| 6,107,628 | A | 8/2000 | Smith et al. | |
| 6,586,731 | B1 | 7/2003 | Jolliffe | |
| 6,943,347 | B1 | 9/2005 | Willoughby et al. | |
| 7,312,444 | B1 | 12/2007 | Willougbhy et al. | |
| 7,465,940 | B2 | 12/2008 | Franzen | |
| 2002/0158196 | A1 * | 10/2002 | Berggren et al. | 250/288 |
| 2004/0026614 | A1 * | 2/2004 | Bateman et al. | 250/281 |
| 2006/0289746 | A1 * | 12/2006 | Raznikov et al. | 250/294 |
| 2007/0278400 | A1 * | 12/2007 | Schurenberg et al. | 250/288 |
| 2008/0104064 | A1 | 5/2008 | Li | |
| 2008/0173809 | A1 * | 7/2008 | Wu | 250/283 |
| 2010/0193679 | A1 | 8/2010 | Nikolaev et al. | |

* cited by examiner

*Primary Examiner* — Nicole Ippolito
(74) *Attorney, Agent, or Firm* — O'Shea Getz P.C.

(57) ABSTRACT

Charged droplets are guided along a defined path from a droplet source to a droplet sink. A focusing pseudopotential distribution generated by audio frequencies on electrodes of a guiding device guide the charged droplets from the droplet source to the droplet sink with low loss. The droplets can be driven along the droplet guide by a gas flow, an axial electric field or a combination of both. For example, charged droplets from a spray capillary of an electrospray ion source at atmospheric pressure may be introduced into the inlet capillary leading to the vacuum system of ion analyzers, a procedure similar to that used up to now in nanoelectrospraying, but with substantially higher flow rates. In the guiding device, the droplets can be manipulated in different ways, for example evaporated down to a desired size. The introduction of small droplets into gas-aspirating capillaries is of interest because it is possible to keep the droplets on axis by Bernoulli focusing and to guide them in large quantities and with low loss through the capillary. The ability to guide the droplets makes it also possible to install a segmented inlet capillary with intermediate pumping, which allows pumping capacity to be saved. Advantageously, the sensitivity of ion analyzers such as mass spectrometers or ion mobility spectrometers by at least one order of magnitude.

15 Claims, 3 Drawing Sheets

GUIDING SPRAY DROPLETS INTO AN INLET CAPILLARY OF A MASS SPECTROMETER

PRIORITY INFORMATION

This patent application claims priority from German Patent Application No. 10 2009 037 715.8 filed on Aug. 17, 2009, which is hereby incorporated by reference.

FIELD OF INVENTION

The invention relates to the field of mass spectrometry, and in particular to guiding charged droplets along a defined path into a droplet sink such as, for example, an inlet capillary of a mass spectrometer.

BACKGROUND OF THE INVENTION

Ions may be generated from relatively heavy analyte molecules, having molecular weights of several hundred to several thousand Daltons, using an electrospray ion source. For example, a relatively high voltage (e.g., several kilovolts) may be applied to a pointed spray capillary, containing spray liquid with dissolved analyte molecules, to generate a relatively strong electric field around the tip. The electric field polarizes and charges the surface of the spray liquid in the open tip. In this manner, an electric tractive force creates a so-called "Taylor cone" on the surface of the liquid, and an electric field draws a fine jet of liquid out of the tip of the cone. The jet is intrinsically unstable due to its high surface charge, which opposes the surface tension. The jet disintegrates by constriction into minute, highly charged droplets with diameters on the order of a hundred nanometers to a few micrometers.

The size of the droplets depends on the tip aperture and the electric field generated around the tip of the spray capillary. Nanoelectrospray ionization, for example, uses apertures of approximately two to three micrometers. Such tip apertures can generate droplets with 100 to 200 nanometer diameters using a spray voltage of less than one kilovolt at flow rates of a few tens to a maximum of one thousand nanoliters per minute. "Normal" electrospraying, on the other hand, uses tip apertures of approximately ten to thirty micrometers in diameter. Such tip apertures can generate droplets with one to two micrometer diameters using a spray voltage of three to five kilovolts at flow rates of one to a several thousand microliters per minute. The droplets generated with normal electrospraying therefore have a volume more than a thousand times larger than nanospray droplets. Droplets with a diameter of around one micrometer carry about 50,000 elementary charges.

The decomposition of the jet of liquid into droplets can be supplemented using a focused jet of spray gas. The spray gas is blown in around the tip of the capillary by a concentric spray gas capillary. This causes the jet of droplets to be guided in a somewhat more focused manner, although the droplets are created with greater diameter variance.

The droplets are evaporated in a hot drying gas to vaporize neutral solvent molecules. This causes the charge density on the surface to continuously increase. When the charge density on the surface becomes so large that the Coulomb repulsion exceeds a force of cohesive surface tension (i.e., "Rayleigh limit"), the droplets split into smaller droplets. The unstable surface brings about random oscillations of the fluid on the surface, for example, cause the droplets to split. The separation of the droplets, however, causes the charges of both droplets to fall below the Rayleigh limit.

The smaller droplets have a higher charge relative to their mass since the total charge $q_R$ of a droplet at the Rayleigh limit is proportional to the root of the third power of the diameter d, ($q_R \approx \sqrt{d^3}$). Each small droplet therefore has, for example, two per cent of the mass, but fifteen per cent of the charge. Both small and large droplets, however, have a mass-to-charge ratio above the Rayleigh limit and thus continue to vaporize.

Different-sized droplets, with charge densities at their respective Rayleigh limit, have different electric mobilities $\mu = v/E$ (v=velocity) when being pulled through gas by electric fields of field strength "E". Slow motions of the droplets without eddying are subject to Stokes' law, exhibiting friction proportional to the diameter "d" and the velocity "v" of the droplets. The electric mobility "μ" is therefore proportional to $\sqrt{d}$. As a result, larger droplets have higher electric mobilities than smaller droplets. Rapid motions with turbulent eddying are subject to Newtonian friction, proportional to the cross-section $d^2$ and the square of the velocity $v^2$. Under these conditions, which usually do not, however, apply to spray droplets and their velocities in drying gases, the electric mobility μ is proportional to the inverse root $E^{-2}$ of the field strength E and the inverse fourth root $d^{-4}$ of the diameter d.

Each droplet, large and small, continues to vaporize. The rate of vaporization of the small droplets increases since the coordination number of their surface molecules gets smaller. The vapor pressure therefore increases until the splitting off and vaporization processes end relatively rapidly in the complete drying of the droplets leaving multiply charged analyte ions that were included in the droplets. In the last phase, protonated water molecules may also vaporize. The fowled analyte ions are, for example, generally only surrounded by a somewhat more strongly bound sheath of one to two molecular layers of solvent molecules, usually water molecules.

As indicated above, there are two basic types of electrospraying: nanoelectrospraying (also referred to as "nanospraying") and normal electrospraying (also referred to as "microspraying"). In nanospraying, the droplets are typically sprayed directly into the inlet capillary leading to the ion analyzer. In microspraying, in contrast, analyte ions generated by being vaporized in free air are directed into the inlet capillary.

Nanospraying generates very small droplets with substantially equal diameters (e.g., approximately 100 to 200 nanometers). The droplets are drawn into the inlet capillary by and accelerated in a transport gas. A typical transport gas includes nitrogen at a temperature between room temperature and 300 degrees Celsius. The droplets vaporize slowly in the inlet capillary, supported by an ever decreasing pressure.

Advantageously, gas-dynamic focusing can guide the droplets through the capillary with relatively low losses. In the inlet capillary, for example, brief boundary turbulences give way to a stable laminar flow of the transport gas with a parabolic velocity profile; i.e., where the flow is fastest in the center and resting at the capillary wall. The droplets are entrained by the fast gas stream, and are held in the axis of the capillary. When droplets swerve to the side, they enter a gas stream region which flows at different speeds on either side. The Bernoulli effect drives the particles back toward the axis using lift, similar to that experienced by an airplane wing.

The greater the difference in velocity between the gas and droplets, the stronger the "Bernoulli focusing". This is because the lift is proportional to the difference between the squares of the velocities on either side of the droplet. Since the gas flow rate increases towards the end of the inlet capillary, the droplets do not travel as fast as the gas. The focusing effect is therefore maintained until the droplets are completely vaporized or have left the capillary. An opposing electric field in the inlet capillary can further enhance the focusing effect by decelerating the droplets to prevent them from assuming the velocity of the gas. It is unclear, however, whether larger analyte ions are also subject to the Bernoulli focusing when they are decelerated by an opposing field, and whether this focusing can be effective against the repulsion by the space charge prevailing in the axis.

Disadvantageously, the spray capillary tips used for nanospraying must be precisely adjusted with respect to the inlet capillary aperture. The ion sources therefore are usually equipped with microscopes or micro cameras for aligning the tips. Furthermore, as indicated above, nanospraying has relatively low flow rates.

During microspraying, in contrast, the droplets are vaporized outside the inlet capillary, thus releasing the analyte ions. The analyte ions generally have a solvate layer. The analyte ions lose the solvate layer, however, on their way through the inlet capillary into the vacuum system as they are heated by hot transport gas and as pressure along the inlet capillary decreases. The hot transport gas directs the analyte ions into the admission aperture of the inlet capillary. However, very few of the analyte ions are directed into the admission aperture due to the large volume of analyte ions that are produced. Microspraying therefore feeds far less than one percent of the sprayed analyte molecules into the ion analyzer in ionized form.

During both nanospraying and microspraying, the inlet capillary guides the charged analyte molecules into a vacuum system of an ion analyzer. The ion analyzer can be, for example, a mass spectrometer or an ion mobility spectrometer. The analyte ions are captured in the vacuum system by, for example, an ion funnel separated from the accompanying transport gas and introduced into the ion analyzer via additional ion guides and pumping stages. The analyte ions are analyzed in the ion analyzer. A single inlet capillary can be used to introduce the analyte ions into the vacuum. Several inlet capillaries can also be bundled together to introduce the analyte ions into the vacuum. Hereinafter the term "inlet capillary" shall be used generically to refer to both a sole capillary and a bundle of capillaries.

Most of the analyte ions are multiply charged. The number of charges, however, can vary for a single substance. The average number of charges increases roughly in proportion to the mass of the analyte ions. For heavy ions, for example, the mass-to-charge ratios m/z (m=mass; z=number of excess elementary charges of the ion) have a wide distribution from approximately m/z=700 Daltons to approximately m/z=1, 600 Daltons. The heavy molecules of albumin (m=66 kDa), for example, have a 50-fold charge on average, while light molecules with molecular weights below m=2 kDa are predominantly singly charged. The distribution of the charges can be affected by the composition of the solvent, the spraying processes and the processes with which the ions are guided through gases.

The droplets in the jet of spray strongly repel each other since each droplet is highly charged (e.g., with 50,000 elementary charges for one droplet with a diameter of one micrometer). The jet of spray droplets accelerated in the electric field therefore broaden to a cloud with a pronounced funnel shape almost immediately after the droplets have been formed. During nanospraying, the broadening is limited by the transport gas with which the cloud of droplets is drawn into the inlet capillary and which entrains and accelerates the droplets. During microspraying, in contrast, the volume of the gas containing the analyte ions after the liquid has vaporized from the droplets is considerably larger. It is therefore difficult to draw a large number of analyte ions from the large volume into the inlet capillary. A focused jet of spray gas, which can be heated up to about 150° C., can be introduced concentrically around the spray capillary to reduce the volume in a radial direction. The reduction in volume, however, further accelerates the spray droplets. This produces an elongated ion formation volume of moderate width, but in which many fast, unvaporized droplets are flying through the cloud of analyte ions.

An elongated and moderately wide volume with analyte ions is produced from the spray gas. The ions are usually extracted perpendicularly and fed to the inlet capillary. The extraction is generally successful for only a small fraction of the analyte ions, however, because only analyte ions from a small section of the length and width of the ion formation volume reach the inlet capillary. A "super hot" sheath gas at a temperature of about 300° C. is blown in around the hot spray gas to focus the ion formation volume in the radial direction and, therefore, "thermally focus" the droplets.

Although normal electrospraying ionizes most of the analyte molecules when the droplets are completely vaporized, the yield of ions introduced into the analyzer is relatively small. Nevertheless, normal electrospraying is widely used because it can be easily coupled to the normal flow rates of analytical liquid chromatography (HPLC). Nanospraying, in contrast, provides a relatively high yield of analyte ions. Nanospraying, however, cannot typically be coupled with liquid chromatography without splitting the flow of liquid since nano-HPLC has flow rates which are far above those which nanospraying can cope with. The unfavorable splitting of the liquid flow therefore cancels out the favorable ion yield. Attempts to inject larger droplets, which are produced at slightly higher flow rates with slightly larger spray tip aperture diameters, directly into the inlet capillary have so far been unsuccessful.

There is a need for an improved technique of guiding spray droplets into an inlet capillary of a mass spectrometer.

SUMMARY OF THE INVENTION

According to one aspect of the invention, a guiding device generates a pseudopotential that introduces a cloud of charged droplets from a droplet source into a droplet sink The guiding device can be designed as a multipole rod system, as a stack of diaphragms, or any other suitable pattern of electrodes disposed around a droplet propagation path. The guiding device can be operated up to, for example, atmospheric pressure at relatively low frequencies (e.g., audio frequencies) for charged particles of greater mass. The guiding device may be referred to as a "droplet guide". Focusing of the charged droplets is increased using an alternating field having the cross-section of a quadrupole, a so-called "two dimensional quadrupole field".

The charged droplets can be moved in the axial direction within the droplet guide using a gas flow, an axial electric field or an electric traveling field. Droplets of different size can be moved in different directions as a function of their different mobilities. Large droplets, for example, can be substantially contained in the droplet guide until the larger droplets have evaporated and/or broken down to a desired size.

The droplet source can be configured as an electrospray device, and the droplet sink can be configured as an inlet capillary. The spray droplets from the spray capillary should not be evaporated before they enter the inlet capillary. The cloud of droplets should also be fed into an entrance aperture of the inlet capillary as completely as possible, finely focused by the pseudopotentials of the droplet guide. The droplets are introduced into the inlet capillary since, as indicated above, the droplets can be guided through the capillary with low losses by Bernoulli focusing. Spray capillaries with liquid flow up to a few hundred microliters per minute can be used. The droplets should have a relatively small size before being directed into the inlet capillary in high numbers. The droplets should not, however, completely evaporate before being introduced into the inlet capillary.

In order to introduce substantially small, equi-sized droplets (e.g., with a diameter between 50 to 200 nanometers) into the inlet capillary, larger droplets should be retained in a drying gas longer than smaller droplets. This may be achieved by generating a flow of a hot drying gas and an opposing electric field in the droplet guide. The hot drying gas and the electric field are generated such that the smaller droplets move faster through the droplet guide towards the inlet capillary than do the larger droplets. If the droplets move relatively slowly through a moving drying gas, the mobility of droplets at the Rayleigh limit is proportional to the root of the diameter, and thus higher for larger droplets than for small droplets, an effect which can be utilized. The droplets retained longer in the droplet guide thus have more time to vaporize. The final evaporation of the spray droplets, however, should occur after the droplets have left the droplet guide (i.e., in the inlet capillary) because otherwise the analyte ions may be drawn to the electrodes of the droplet guide and be discharged.

The alternating electric field in the droplet guide deforms larger droplets via shaking motions. The shaking motions destabilize the droplets such that each droplet experiences a perturbation of the spherically symmetrical charge distribution. In this manner, the destabilized droplets can be torn (or broken) into smaller droplets. When larger droplets do not readily decompose in the alternating electric field, vaporization can be increased by irradiating the droplets with infrared light or microwaves. Nebulization by ultrasound is also possible.

After the droplets have been introduced into the inlet capillary, gas-dynamic focusing (Bernoulli focusing) directs the droplets for as long as possible along the axis of the inlet capillary. Premature complete evaporation of the droplets therefore should be prevented. The evaporation can be controlled by selecting the size of the droplets introduced and by controlling the humidity of the transport gas. The focusing may be enhanced by generating an opposing electric field in the inlet capillary.

The inlet capillary may be segmented into a plurality of segments such that a large proportion of the inflowing transport gas can be evacuated with small pumps at relatively high pressure. The droplets are guided between the segments using embodiments of the aforesaid droplet guide. A small quadrupole rod system, for example, can guide droplets from a first segment to an aperture of a second segment. New transport gas with a desired temperature and humidity can be fed into each new segment such that, for example, the droplets evaporate in the last segment. Such segmented inlet capillaries make it possible to select capillaries with larger internal diameters and, therefore, increase gas throughput. As a result, more droplets can be transported.

Where the droplets are introduced into a first stage of a vacuum system, the droplets can be evaporated. The droplets can also burst into smaller droplets or even into analyte ions when, for example, they impact against hot surfaces.

Advantageously, an extraordinarily large number of ionized analyte molecules can be introduced into the vacuum system of an ion analyzer using the aforesaid droplet guides, even at spray capillary flow rates of up to a few hundred microliters. Low concentrations of analyte molecules therefore can be detected by the ion analyzer. The sensitivity of the ion analyzer therefore can increase by, for example, at least one order of magnitude. This new type of electro-spray ion source can be coupled particularly well with nano-liquid chromatographs, and also with chip-based separating systems.

These and other objects, features and advantages of the present invention will become more apparent in light of the following detailed description of preferred embodiments thereof, as illustrated in the accompanying drawings.

DETAILED DESCRIPTION OF THE INVENTION

Figure 1:
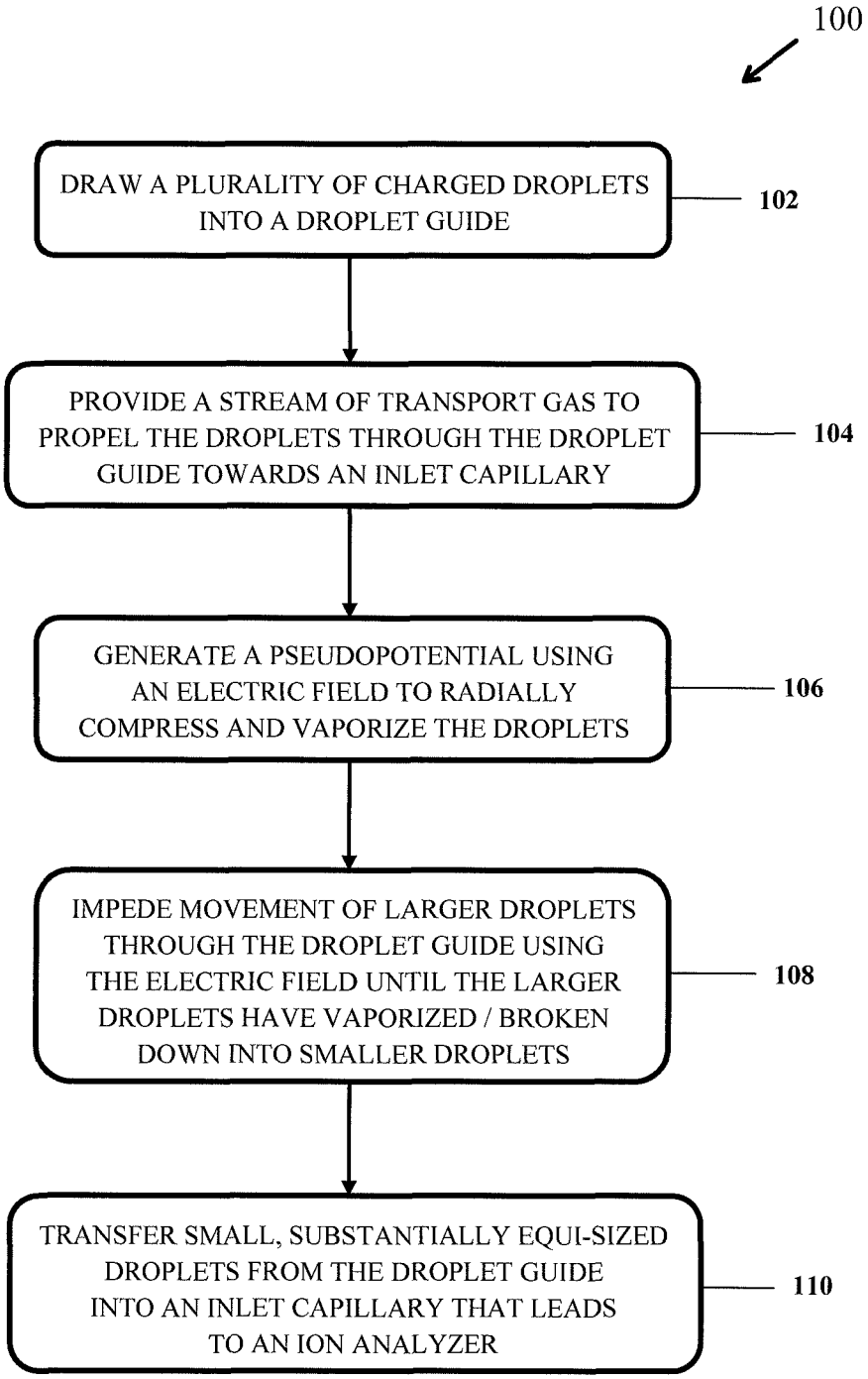
FIG. 1 is a flow diagram showing one embodiment of a method for forming a jet of droplets using a guiding device.

FIG. 1 illustrates a process 100 for forming a jet of droplets using a guiding device (also referred to below as a "droplet guide"). The jet of droplets is fowled by radially compressing a cloud of charged droplets received from a droplet source, and guiding the droplets along a predefined path to a droplet sink (see steps 102, 104 and 106). The droplets are compressed and guided by audio-frequency alternating voltages applied to electrodes in the guiding device. The term "droplet source" refers to the appearance of droplets at one point of a defined observation region. The term "droplet sink" refers to the disappearance of the droplets at a different point in the region observed.

The cloud of charged droplets is compressed by inhomogeneous alternating fields on the droplets; i.e., creating "pseudopotentials". Pseudopotentials are generally known in the art and, therefore, will not be discussed in further detail. The jet of droplets can be compressed (or "focused") by generating a two-dimensional quadrupole field. The jet of droplets can also be compressed by two-dimensional higher-order multipole fields, such as hexapole or octopole fields, which exert a slightly weaker effect than the two-dimensional quadrupole field.

The droplets can be moved in the axial direction, in an interior of the guiding device, using at least one of friction in a gas flow, axial electric fields, or a traveling electric field with traveling potential minima (see step 104).

Figure 2:
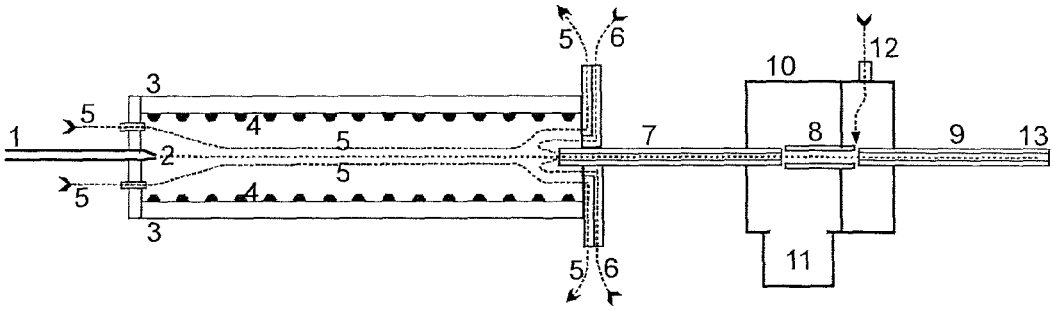
FIG. 2 is a schematic illustration of one embodiment of an electrospray ion source.

Referring to FIGS. 1 and 2, one embodiment of an electrospray device is shown for centrally introducing finely focused spray droplets (e.g., with uniform size) into an entrance aperture of an inlet capillary leading to an ion analyzer (see step 110). Advantageously, the electrospray device has higher flow rates (e.g., up to a few hundred microliters per minute) than prior art devices.

A spray capillary 1 may have an aperture with a diameter of between approximately five and ten micrometers. A voltage of between approximately two and four kilovolts, with respect to the average voltage on electrodes 4 of a droplet guide 3, is applied to the spray capillary 1. The spray capillary 1 may feed a liquid stream of approximately 10 microliters per minute to the spray tip, preferably from a nano-HPLC. The liquid, for example water mixed with some organic solvents such as acetonitrile, includes analyte molecules in solution. A sequence of droplets 2 is drawn out of this liquid by the electric drawing field, forming a Taylor cone. Pseudopotentials generated by the guiding device 3, 4 focus the cloud of droplets into a fine jet.

The guiding device can be configured as a multipole rod system, a stack of ring diaphragms, or any other suitable form of RF ion guide. Other suitable RF ion guides include, but are not limited to, those used for the guiding ions in high and medium vacua. For charged particles of larger mass, these guide systems may operate at far higher pressure, here at atmospheric pressure. The alternating voltages used, however, have lower frequencies. To guide the highly charged droplets, the guide system can be operated with alternating voltages of between approximately 20 and 3,000 volts in an audio frequency range between approximately 20 and 20,000 hertz.

A tube is used as the droplet guide 3. The tube 3 has an electrode pattern 4 on the inside to generate a two-dimensional quadrupole AC field and an axial DC field with an arbitrary field strength profile. The tube 3 can have a diameter of, for example, approximately ten millimeters and a length of, for example, approximately ten centimeters.

Figure 3:
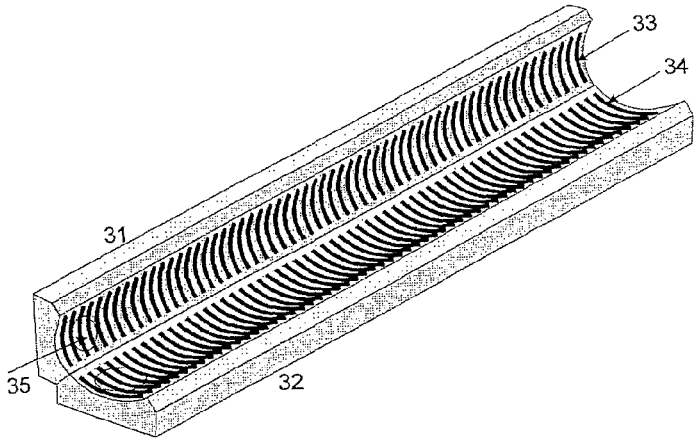
FIG. 3 is a partial perspective diagrammatic illustration of one embodiment of a tubular droplet guide included in the electrospray ion source shown in FIG. 2.

Referring to FIG. 3, the droplet guide 3 (e.g., the tube) includes, for example, four ceramic main bodies, two of which 31, 32 are shown. Each main body e.g., 31, 32 includes a plurality of embedded wire-shaped electrodes e.g., 33, 34, respectively. The electrodes 33, 34 generate a quadrupole AC field (also referred to as a "quadrupole alternating field") in a radial direction and a DC electric field profile in an axial direction when suitable AC and DC voltages are applied thereto. The quadrupole alternating field forms a quadrupolar field in the center of the droplet guide. The quadrupolar field, however, is distorted towards inside edges of the ceramic bodies 31, 32.

Figure 4:
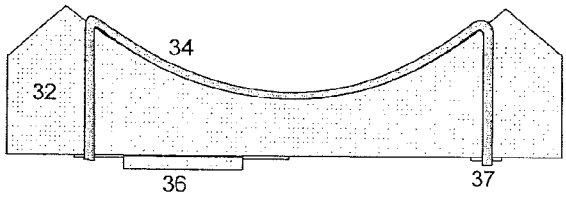
FIG. 4 is a cross-sectional diagrammatic illustration of one embodiment of a ceramic main body included in the tubular droplet guide shown in FIG. 3.

Referring to FIG. 4, the AC and DC voltages can be generated by a plurality of voltage dividers included in a printed circuit 36 disposed on a back surface of each ceramic main body 31, 32. Alternating voltages of a few hundred volts with frequencies between approximately 2 and 10 kilohertz are used for focusing the droplets. Adjacent wires can carry alternating voltages of the same phase, but with different amplitudes, to prevent the droplets from getting too close to the wires. A strong pseudopotential is generated, close to the wires, that repels the droplets. The insulating surfaces can also be coated between the wires with a high-resistance layer to discharge the charges of impacting droplets. Alternatively, the wires can be replaced with flat metal strips that cover a large portion of the surface (not shown). In some embodiments, the metal strips overlap, without touching, to completely cover the insulating base.

Referring to FIGS. 1 and 2, the tube 3 of the droplet guide includes one or more gas inlets and one or more gas outlets at each end. A first gas inlet supplies the heated drying gas 5 in the direction against the axial electric drawing field (see step 104). A second gas inlet supplies the transport gas 6. The transport gas 6 is injected in the tube downstream of the first inlet for the heated drying gas 5, and is drawn, for example, in almost completely by the inlet capillary 7. The temperature and humidity of the transport gas 6 can be controlled independently of the drying gas 5 such that the droplets in the inlet capillary 7 remain unevaporated for as long as necessary.

The tube 3 of the droplet guide is initially aligned with respect to the aperture and the axis of the inlet capillary when the ion source is assembled. Advantageously such an alignment need not be repeated as is typically necessary with prior art nanospraying devices.

Small, substantially equi-sized droplets with relatively low mobilities are directed by the droplet guide into the inlet capillary 7 (see step 110). Larger droplets with relatively high mobilities, in contrast, are substantially contained in the droplet guide until, for example, being evaporated or split to form smaller droplets (see step 108). This is accomplished by propelling the small droplets forward with the drying gas 5 (i.e., providing forward propulsion), and impeding forward movement of the larger droplets with the axial electric field. In this manner, the smaller droplets are propelled faster through the droplet guide than the larger droplets.

A calculation of Reynolds numbers for the droplets shows that the droplets move strictly in the region of Stokes friction. When Stokes friction occurs, the mobility of droplets at the Rayleigh limit is proportional to the square root of the diameter d. The mobility of larger droplets is therefore higher than for smaller droplets. When the magnitude of the gas flow and the axial voltage profile are set correctly, the larger droplets can be retained longer in the droplet guide 3, 4, providing additional time to vaporize. The voltage profile may be tailored having a non-linear field strength, weak at the entrance and high at the exit of the droplet guide. The size of the droplets introduced into the inlet capillary is determined by the setting of the field strength at the end of the droplet guide and the setting of the flow of the drying gas 5. The droplet diameters are between about 20 and 200 nanometers and, in particular, about 50 nanometers. The field strength at the end of the droplet guide and drying gas flow are best adjusted by optimizing the analytical sensitivity; i.e., by increasing the ion current when a liquid with a constant analyte concentration is supplied.

The voltage and frequency of the audio-frequency alternating voltage applied to the electrodes is selected to increase the speed that heavier droplets vaporize and break up into smaller droplets (see step 106). The droplets are vaporized by the shaking movement in the alternating electric field, and broken up into smaller droplets by the deformation caused by the shaking movement. The space charge drives larger droplets further away from the axis of the guiding device than the smaller droplets due to their smaller m/z. In other words, the larger droplets are subject to a stronger alternating field. The larger droplets therefore are not driven as strongly as the smaller droplets against the axial field by the flow of the drying gas, which has a parabolic velocity distribution.

Generally, the lower the frequency of the alternating voltage, the greater the shaking movement of the droplets. The frequency of the alternating voltage therefore can be selected to control the vaporization of the larger droplets. The selection of voltage determines the diameter of the cloud, and the selection of frequency determines the amplitude of the shaking motion. The selected voltage and frequency, however, are not independent of each other. The higher the frequency is set, for example, the higher the voltage is set to maintain a cloud with the same diameter. In one embodiment, the audio-frequency alternating voltage is set having a frequency between approximately five to ten kilohertz, and a voltage up to several thousand volts.

The droplets in the droplet guide can also be vaporized using infrared radiation, ultrasound or microwaves. A wavelength of infrared light, for example, can be adjusted as a function of the solvent sprayed water in order to achieve high absorption.

Gas-dynamic focusing (also referred to as "Bernoulli focusing") keeps the droplets on the axis of the inlet capillary once they have been introduced into the inlet capillary. Premature evaporation of the droplets should be prevented when the focusing is maintained over a substantial portion of the inlet capillary 7 by selecting the size of the droplets introduced and by controlling the humidity of the transport gas 6 directed into the inlet capillary 7. The focusing can be enhanced using an opposing electric field in the inlet capillary. The electric field reduces the velocity of the droplets with respect to the gas, and the focusing Bernoulli lift for the droplets toward the axis of the inlet capillary increases.

The inner surface of the inlet capillary 7 can be coated with a high-resistance layer to discharge impacting droplets or ions and, thus, prevent an accumulation of charges. This layer also helps to form a uniform opposing electric field. Various techniques for the production of high-resistance layers in glass capillaries are known in the art and, therefore, will not be discussed in further detail.

The inlet capillary can also be divided into two or more segments, in order to pump off most of the inflowing transport gas with small pumps at relatively high pressure. Such an intermediate pumping station 10 with a pump 11 is schematically shown in FIG. 2. The inlet capillary is divided into two segments 7 and 9 within the intermediate pumping station 10. The droplets which emerge from the segment 7 are guided via a droplet guide 8 to the entrance of the next segment 9 of the inlet capillary and collected in the aperture of the inlet capillary 9. The droplet guide 8 is configured as a very small quadrupole rod system as described above. The droplet guide 8 uses high alternating voltage frequencies and low alternating voltages since the pressure of the gas is low and the velocity of the droplets high. Advantageously, a relatively small pump 11 can be used since the transport gas can be pumped away at a significantly higher pressure than at the end of a single stage embodiment of the inlet capillary 7.

New transport gas 12, with desired temperature and humidity, can be directed through the segment 9 such that the droplets, for example, evaporate therein. The inlet capillary, however, can include more than two segments. Advantageously, the segmented inlet capillary reduces pump capacities, while increasing gas throughputs by using capillaries which have larger internal diameters in individual segments.

The electrospray device therefore introduces high numbers of ionized analyte molecules into the vacuum system of the ion analyzer, even at flow rates in the spray capillary up to a few hundred microliters. The electrospray ion source may be then be coupled with nano-liquid chromatographs, and with chip-based separation systems, without having to split the flow of liquid.

Figure 5:
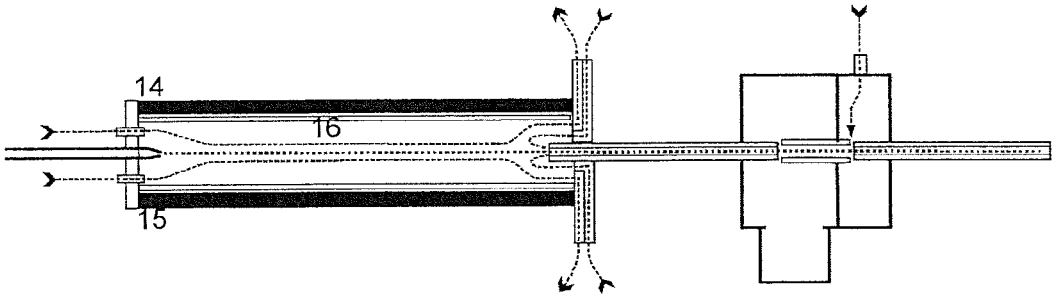
FIG. 5 is a schematic illustration of another embodiment of an electrospray ion source.

Referring to FIG. 5, an alternative embodiment of the electrospray device is shown that includes a tube made of a "leaky dielectric" (i.e., a dielectric with very poor conductivity) configured within the quadrupole rod system. While the alternating electric field is slightly weakened as it passes through the dielectric, the voltage drop over the poorly conducting dielectric can generate the axial DC field that works against the flow of the drying gas. The spray capillary sprays directly into the tube when the spray capillary is set at a potential which differs from the potential of the poorly conducting dielectric by a few kilovolts. A slightly conical tube constructed from poorly conducting dielectric material can be used, for example, to vary the ratio of flow strength and the electric field along the axis.

The droplet and/or ion guides can be operated with and without axial forward propulsion of the ions by axial electric fields. Axial fields can be generated, for example, by segmented quadrupole rod systems or by quadrupole rod systems with non-conducting high-resistance coatings. Ion guides with forward propulsion can also be used in the form of diaphragm stacks. Helically wound high-resistance wires can also be used. All these forms can be used according to the invention in electrospray devices.

Although the present invention has been illustrated and described with respect to several preferred embodiments thereof, various changes, omissions and additions to the form and detail thereof, may be made therein, without departing from the spirit and scope of the invention.

What is claimed is:

1. A method for transferring charged droplets along a path, comprising:

providing a guiding device including a plurality of electrodes configured as one of a (i) multipole rod system, (ii) a stack of apertured diaphragms and (iii) a pattern of electrodes disposed around the path;

generating a radial pseudopotential distribution by alternating voltages on the electrodes such that the charged droplets are kept radially on the path, wherein the alternating voltages are from the audio-frequency range between approximately 20 and 20,000 hertz, and have an amplitude of between approximately 20 and 3,000 volts; and transferring the charged droplets along the path from a droplet source through the guiding device to a droplet sink, the droplet sink being a gas-aspirating inlet capillary leading to an ion analyzer operating in a vacuum, wherein the charged droplets are introduced into the inlet capillary, and wherein substantially no ions enter the inlet capillary since most of them are drawn to the electrodes of the guiding device and discharged.

2. The method of claim 1, further comprising generating a gas flow profile and an electric field profile along the path in the guiding device, and selecting a transfer velocity dependent on mobility of the charged droplets.

3. The method of claim 2, where direction and the profile of the electric field and direction and the profile of the gas flow in the guiding device are configured such that larger droplets with higher mobility remain longer in the guiding device than smaller droplets.

4. The method of claim 3, further comprising:

heating the gas flow such that the charged droplets evaporate down to a desired size within the gas flow without evaporating them completely; and providing charged droplets with substantially equal diameters from the guiding device.

5. The method of claim 1, further comprising generating a two-dimensional quadrupole alternating field with the electrodes.

6. The method of claim 1, further comprising selecting frequency and amplitude of the alternating voltage at the guiding device such that the charged droplets are subject to a shaking motion that causes larger droplets to vaporize and disintegrate down to a desired size faster than smaller droplets without evaporating them completely.

7. The method of claim 1, wherein the droplets in the droplet guide are irradiated with at least one of infrared light, ultrasound and microwaves.

8. The method of claim 1, further comprising generating the charged droplets with an electrospray ion source.

9. An apparatus for transferring charged droplets along a path, comprising:

a droplet source;

a electrospray ion droplet guide including a plurality of electrodes that generate a two-dimensional multipole field on an axis of the droplet guide; and a gas-aspirating inlet capillary leading to an ion analyzer in a vacuum;

an audio AC voltage generator supplying the electrodes of the droplet guide with AC voltages having a frequency of between approximately 20 and 20,000 hertz and an amplitude of between approximately 20 and 3,000 volts so that the droplets generated by the droplet source can be transferred through the droplet guide to the inlet capillary where they enter the inlet capillary, wherein substantially no ions enter the inlet capillary since most of them are drawn to the electrodes of the droplet guide and discharged.

10. The apparatus of claim 9, wherein the two-dimensional multipole field generated by the electrodes is a two-dimensional quadrupole field.

11. The apparatus of claim 9, where the droplet guide includes an insulating tube, and where the electrodes are disposed on an inner surface of the insulating tube.

12. The apparatus of claim 11, wherein the electrodes in the insulating tube form a pattern that generates both a radial two-dimensional quadrupole alternating field and an axial DC field profile.

13. The apparatus of claim 9, further comprising a gas supply to supply gas to the droplet guide.

14. The apparatus of claim 9, where the droplets are generated by a spray capillary of an electrospray device.

15. The apparatus of claim 9, wherein the droplets exit a first segment of a segmented inlet capillary, and are transferred by the droplet guide to a next segment of the segmented inlet capillary.

* * * * *

UNITED STATES PATENT AND TRADEMARK OFFICE

CERTIFICATE OF CORRECTION

PATENT NO. : 8,513,599 B2
APPLICATION NO. : 12/857161
DATED : August 20, 2013
INVENTOR(S) : Franzen et al.

It is certified that error appears in the above-identified patent and that said Letters Patent is hereby corrected as shown below:

In the Specification:

Column 2
Line 30, please delete “fowled” and insert --formed--

Column 6
Line 31, please delete “fowled” and insert --formed--

Signed and Sealed this
Twenty-fourth Day of September, 2013

Teresa Stanek Rea
*Deputy Director of the United States Patent and Trademark Office*